US009805897B2

(12) United States Patent
Benke et al.

(10) Patent No.: US 9,805,897 B2
(45) **Date of Patent: *Oct. 31, 2017**

(54) FUSE WITH CARBON FIBER FUSIBLE ELEMENT

(71) Applicant: EATON CORPORATION, Cleveland, OH (US)

(72) Inventors: James Jeffrey Benke, Pittsburgh, PA (US); Robert Neville Parry, Beaver, PA (US); Nicholas Paul Brusky, Valencia, PA (US)

(73) Assignee: EATON CORPORATION, Cleveland, OH (US)

( * ) Notice: Subject to any disclaimer, the term of this patent is extended or adjusted under 35 U.S.C. 154(b) by 8 days.

This patent is subject to a terminal disclaimer.

(21) Appl. No.: 14/969,978

(22) Filed: Dec. 15, 2015

(65) Prior Publication Data

US 2016/0099125 A1 Apr. 7, 2016

(51) Int. Cl.

| | |
|---|---|
| ***H01H 85/06*** | (2006.01) |
| ***H01H 85/40*** | (2006.01) |
| ***H01H 85/42*** | (2006.01) |
| ***H01H 85/30*** | (2006.01) |
| ***H01H 85/38*** | (2006.01) |
| ***H01H 85/43*** | (2006.01) |

(52) U.S. Cl.

CPC ..... *H01H 85/06* (2013.01); *H01H 85/30* (2013.01); *H01H 85/303* (2013.01); *H01H 85/38* (2013.01); *H01H 85/40* (2013.01); *H01H 85/42* (2013.01); *H01H 85/43* (2013.01); *H01H 2235/01* (2013.01)

(58) Field of Classification Search

CPC ..... H01H 85/30; H01H 85/38; H01H 85/43; H01H 85/303; H01H 85/42; H01H 85/40; H01H 2235/01; H01H 85/06

USPC ..... 337/159, 227, 273, 281, 290, 296

See application file for complete search history.

(56) References Cited

U.S. PATENT DOCUMENTS

| | | | | |
|---|---|---|---|---|
| 3,406,126 | A * | 10/1968 | Litant | B29C 70/04 252/502 |
| 3,621,431 | A * | 11/1971 | Hitchcock, Sr. | H01H 85/306 337/244 |
| 3,721,936 | A * | 3/1973 | Belcher | H01H 85/303 337/241 |
| 3,895,338 | A * | 7/1975 | Gray | H01H 85/303 337/244 |
| 4,035,755 | A | 7/1977 | Cameron | |
| 4,057,776 | A | 11/1977 | Blewitt et al. | |

(Continued)

FOREIGN PATENT DOCUMENTS

DE 102009012746 A1 9/2010

*Primary Examiner* — Anatoly Vortman

(74) *Attorney, Agent, or Firm* — Eckert Seamans; Nathaniel Walks; Grant Coffield

(57) ABSTRACT

A fuse includes a body, a first conductive terminal coupled with a first end of the body, and a second conductive terminal coupled with a second end of the body. The body, the first conductive terminal, and the second conductive terminal define an exterior of the fuse. The fuse also includes an interruption assembly including a fusible element. The fusible element includes carbon fiber, is disposed on a conductive path between the first conductive terminal and the second conductive terminal, and is configured to break when a current through the fusible element exceeds a predetermined current.

7 Claims, 4 Drawing Sheets

(56) References Cited

U.S. PATENT DOCUMENTS

| | | | | |
|---|---|---|---|---|
| 4,084,145 | A | 4/1978 | Miller | |
| 4,099,153 | A | 7/1978 | Cameron | |
| 4,153,893 | A * | 5/1979 | Swanson | H01H 85/303 337/201 |
| 4,189,694 | A | 2/1980 | Blewitt | |
| 4,204,183 | A | 5/1980 | Blewitt | |
| 4,208,787 | A | 6/1980 | Luck et al. | |
| 4,260,976 | A | 4/1981 | Miller | |
| 4,274,073 | A | 6/1981 | Luck et al. | |
| 4,369,420 | A | 1/1983 | Blewitt | |
| 4,511,876 | A * | 4/1985 | Urani | H01H 85/303 337/241 |
| 4,528,537 | A | 7/1985 | Blewitt et al. | |
| 4,593,262 | A * | 6/1986 | Krueger | H01H 85/36 337/163 |
| 4,664,971 | A | 5/1987 | Soens | |
| 4,873,604 | A | 10/1989 | Goldberg et al. | |
| 4,952,900 | A | 8/1990 | Cameron et al. | |
| 5,357,234 | A | 10/1994 | Pimpis et al. | |
| 5,367,281 | A | 11/1994 | Crooks | |
| 5,426,411 | A | 6/1995 | Pimpis et al. | |
| 5,714,923 | A | 2/1998 | Shea et al. | |
| 5,936,509 | A | 8/1999 | Norte et al. | |
| 6,388,553 | B1 | 5/2002 | Shea et al. | |
| 6,875,374 | B1 | 4/2005 | Zhan et al. | |
| 6,969,504 | B2 | 11/2005 | Smalley et al. | |
| 7,633,370 | B2 | 12/2009 | Benke et al. | |
| 7,683,751 | B2 | 3/2010 | Benke et al. | |
| 2008/0020130 | A1 | 1/2008 | Burke et al. | |
| 2009/0194313 | A1 | 8/2009 | Jiang et al. | |
| 2010/0000754 | A1 | 1/2010 | Mann et al. | |
| 2012/0125656 | A1 | 5/2012 | Wei et al. | |

* cited by examiner

FUSE WITH CARBON FIBER FUSIBLE ELEMENT

CROSS REFERENCE TO RELATED APPLICATION

This application is a divisional application of and claims priority to U.S. patent application Ser. No. 13/705,321, filed Dec. 5, 2012, entitled Fuse with Carbon Fiber Fusible Element.

BACKGROUND

Field

The disclosed concept pertains generally to fuses. The disclosed concept also pertains to expulsion type fuses.

Background Information

Fuses, such as for example, medium voltage fuses, have traditionally used silver or other metal conductors as fusible element material. The size of the cross-section of the fusible element determines the maximum current that can be passed through the fusible element before melting. When relatively low amperage rated fuses are needed, fusible elements with relatively smaller cross-sections are employed. As the cross-section of the fusible element is reduced, the strength of the fusible element is also reduced.

Some fuses also incorporate blown fuse indicators such as a mechanical spring indicator or a chemically activated indicator. In one prior fuse, which uses a mechanical spring indicator, a fusible element is used to bias a spring. When the fusible element breaks, the spring is released which in turn deploys an indicator to indicate that the fuse is blown. In another prior fuse, which uses a chemically activated indicator, a fusible element is used to bias a firing pin. When the fusible element breaks, the firing pin is released which in turn causes a small explosion that deploys an indicator to indicate that the fuse is blown. In both the mechanical spring indicator and the chemically activated indicator, tension is applied to the fusible element. However, as the amperage rating of the fuse is reduced, the strength of the fusible element is also reduced. At relatively low amperage ratings, the tension applied to the fusible element by the mechanical spring indicator or the chemically activated indicator can cause the fusible element to prematurely break.

Expulsion type fuses face a similar difficulty. In one prior expulsion type fuse, tension is applied to the fusible element by a spring such that when the fusible element breaks, the spring pulls the portions of the fusible element away from each other. However, as the amperage rating of the fuse is reduced, the strength of the fusible element is also reduced. When the amperage rating of the fuse becomes too low, the tension applied by the spring can cause the fusible element to prematurely break.

It thus would be desirable to provide an improved fuse that overcomes these and other shortcomings associated with the relevant art.

SUMMARY

These needs and others are met by embodiments of the disclosed concept in which a fuse includes a fusible element which includes carbon fiber.

In accordance with one aspect of the disclosed concept, a fuse comprises a body, a first conductive terminal coupled with a first end of the body, and a second conductive terminal coupled with a second end of the body. The body, the first conductive terminal, and the second conductive terminal define an exterior of the fuse. The fuse also comprises an interruption assembly including a fusible element. The fusible element includes carbon fiber, is disposed on a conductive path between the first conductive terminal and the second conductive terminal, and is configured to break when a current through the fusible element exceeds a predetermined current.

The interruption assembly may further include an indicator assembly including an indicator member structured to provide a visible indication when the fusible element breaks In accordance with another aspect of the disclosed concept, an expulsion type fuse comprises a body, a first conductive terminal coupled with a first end of the body, and a second conductive terminal coupled with a second end of the body. The body, the first conductive terminal, and the second conductive terminal define an exterior of the fuse. The fuse also comprises a fusible element including carbon fiber. The fusible element is disposed on a conductive path between the first conductive terminal and the second conductive terminal, and is configured to break when a current through the fusible element exceeds a predetermined current. The fuse also comprises a spring structured to apply tension to the fusible element such that a first portion of the fusible element moves away from a second portion of the fusible element when the fusible element breaks.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the term "electrical conductor" shall mean a wire (e.g., solid; stranded; insulated; non-insulated), a copper conductor, an aluminum conductor, a suitable metal conductor, or other suitable material or object that permits an electric current to flow easily.

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

As employed herein, the term "low voltage" shall mean any voltage that is less than about 1000 $V_{RMS}$.

As employed herein, the term "medium voltage" shall mean any voltage greater than a low voltage and in the range from about 1000 $V_{RMS}$ to about 38 $kV_{RMS}$.

As employed herein, the term "high voltage" shall mean any voltage that is greater than about 59 $kV_{RMS}$.

Figure 1:
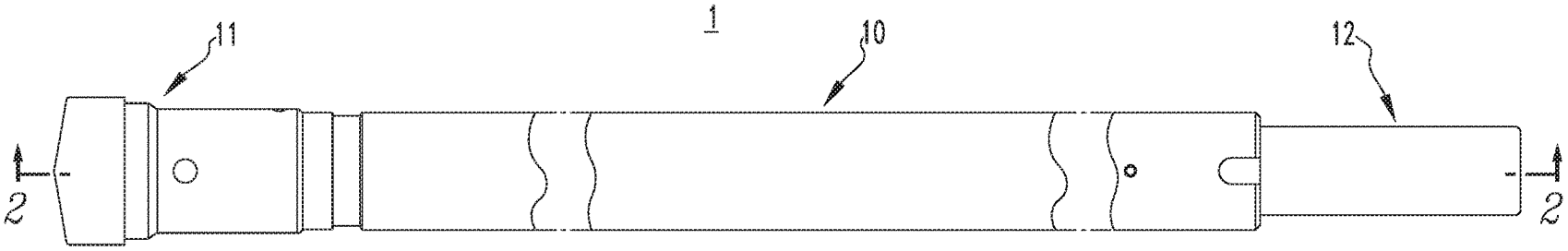
FIG. 1 is a vertical elevation view of an expulsion type fuse in accordance with an example embodiment of the disclosed concept.

FIG. 1 shows an expulsion type fuse 1 according to an example embodiment of the disclosed concept. A hollow insulating body 10 having a first conductive terminal 11 coupled at one end and a second conductive terminal 12 coupled at the other opposite end define an exterior of the expulsion type fuse 1. The conductive terminals 11, 12 can be, for example and without limitation, ferrules or metallic caps. The conductive terminals 11, 12 are electrically connected by a conductive path formed inside the body 10.

Figure 2:
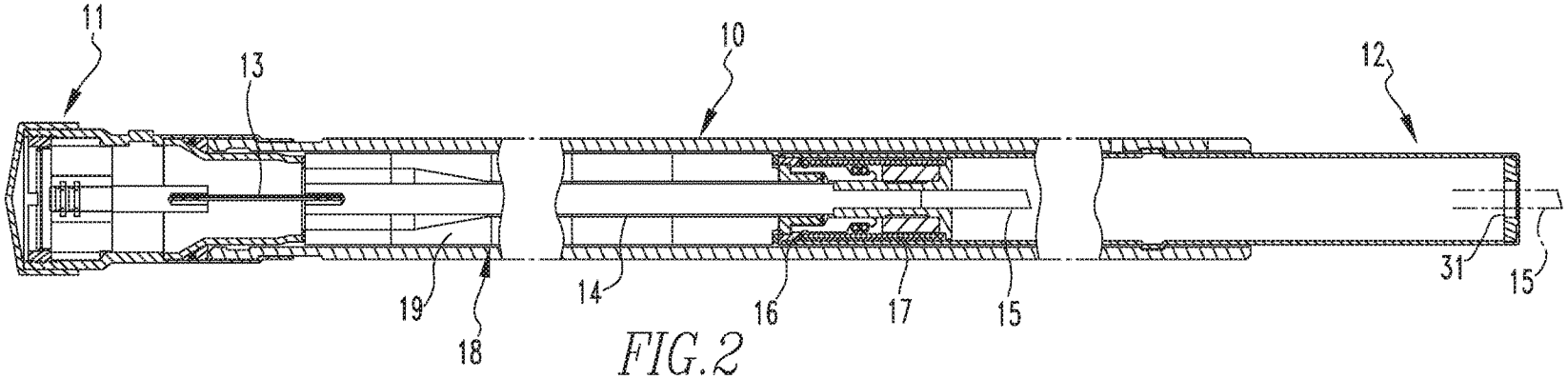
FIG. 2 is a vertical elevation view of the expulsion type fuse shown in FIG. 1.

FIG. 2 shows an interior of the expulsion type fuse 1. The interior of the expulsion type fuse 1 includes a fusible element 13 and an arcing rod 14 disposed on the conductive path between the conductive terminals 11, 12. The fusible element 13 includes carbon fiber, such as for example, a plurality of strands of carbon fiber. The fusible element 13 is electrically connected between the first conductive terminal 11 and the arcing rod 14. The fusible element 13 is structured such that it breaks (e.g., melts) when a current therethrough exceeds a predetermined level, thus interrupting the flow of current through the expulsion type fuse 1. The arcing rod 14 is electrically connected between the fusible element 13 and the second terminal 12. The distal end of the arcing rod 14 is coupled with an indicator 15.

The expulsion type fuse 1 further includes an indicator assembly. The indicator assembly includes the indicator 15 along with a housing 16 and a spring 17. Together, the fusible element 13, the arcing rod 14, and the indicator assembly form an interruption assembly.

The spring 17 is included in the housing 16 and the housing 16 couples the spring 17 with the arcing rod 14 such that the arcing rod 14 moves in conjunction with compression and expansion of the spring 17. When the expulsion type fuse 1 is assembled, the spring 17 is compressed to a non-relaxed state and the fusible element 13 is coupled between the arcing rod 14 and the first terminal 11 to maintain the spring 17 in the compressed state. When the fusible element 13 breaks, the spring 17 is released from its compressed state and expands.

The expansion of the spring 17 pushes the arcing rod 14 toward the second conductive terminal 12. The indicator 15 moves in conjunction with the arcing rod 14 and, when the spring 17 has expanded, a portion of the indicator 15 extends through an opening the second terminal 12 to the exterior of the expulsion fuse 1 (as shown in phantom line in FIG. 2) to provide an indication that the expulsion type fuse 1 has blown.

The movement of the arcing rod 14 also causes the remaining portions of the fusible element 13 to move away from each other. This movement lengthens the arc that is created when the fusible element 13 breaks.

The interior of the expulsion type fuse 1 further includes a chamber 18. An arc-extinguishing material 19 is included in the chamber 18. The arc-extinguishing material 19 may be made of boric acid or any other material that emits an arc-extinguishing gas when exposed to an electric arc. The lengthening of the arc and the arc-extinguishing gas assist with quenching the arc.

Maintaining the spring 17 in the compressed position places the fusible element 13 under tension. As the amperage rating of the expulsion type fuse 1 is reduced, the cross-sectional area of the fusible element 13 is also reduced, thus increasing the possibility that the fusible element 13 will prematurely break due to the tension placed on it by the spring 17. However, carbon fiber can withstand a comparatively larger tension than other typical fusible element materials such as silver alloy or nickel-chrome alloy. As such, the expulsion type fuse 1 employing the fusible element 13 which includes carbon fiber can achieve a relatively lower amperage rating.

Figure 3:
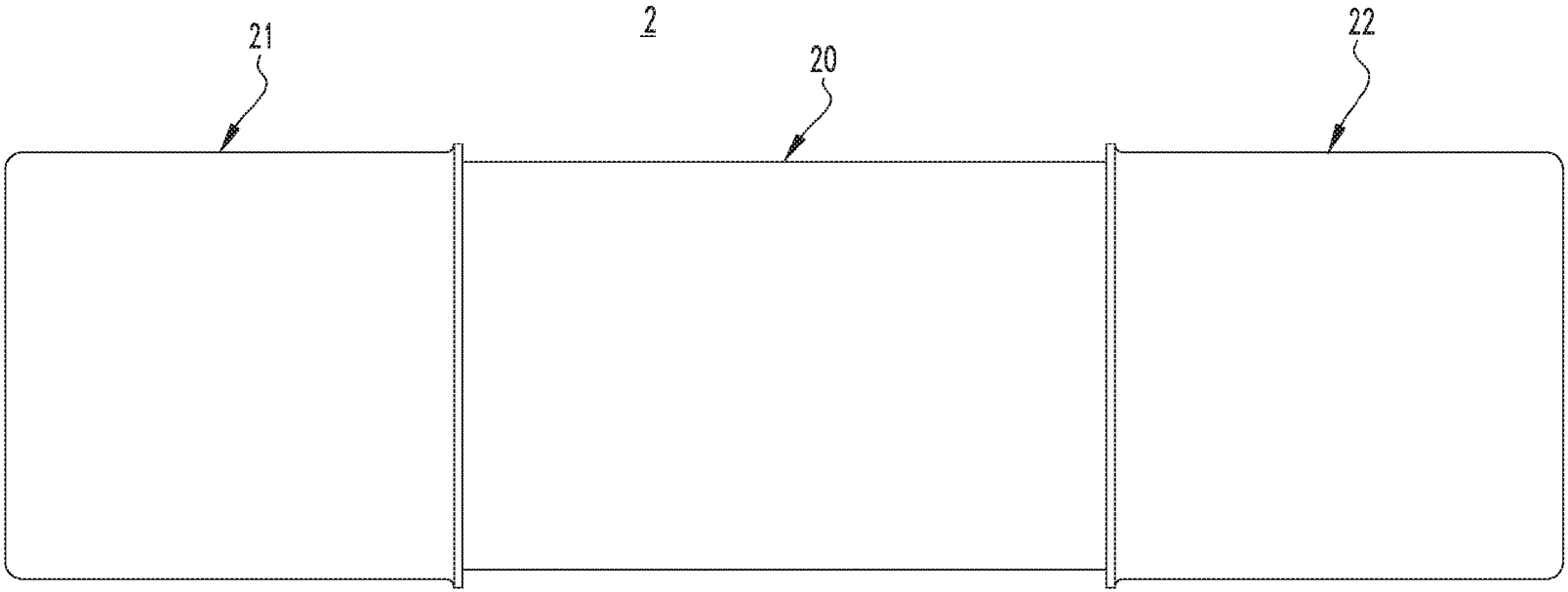
FIG. 3 is a side view of a current limiting type fuse in accordance with another example embodiment of the disclosed concept.

FIG. 3 shows a current limiting fuse 2 in accordance with another example embodiment of the disclosed concept. A hollow insulating body 20 having a first conductive terminal 21 coupled at one end and a second conductive terminal 22 coupled at the other opposite end define an exterior of the current limiting type fuse 2. The conductive terminals 21, 22 can be, for example and without limitation, ferrules or metallic caps. A conductive path through the current limiting type fuse 2 electrically connects the conductive terminals 21, 22. As shown in FIG. 3, the body 20 has an elongated form.

Figure 4:
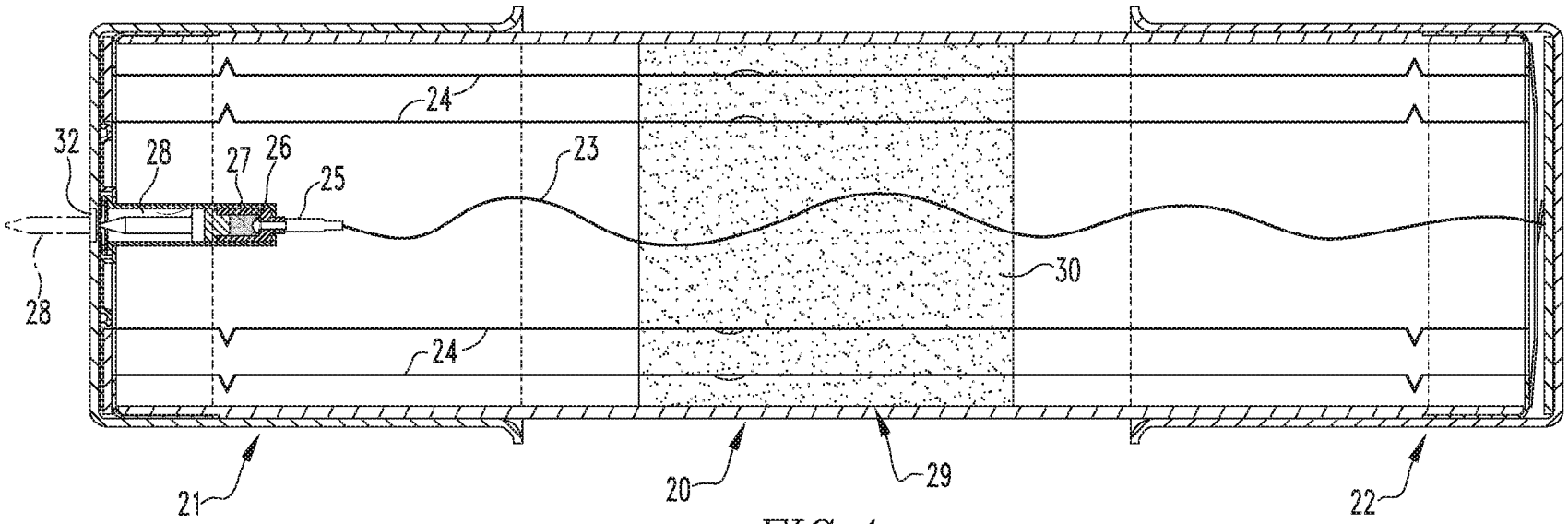
FIG. 4 is a cross-sectional view of the current limiting type fuse shown in FIG. 3.

FIG. 4 shows an interior of the current limiting type fuse 2. A first fusible element 23 is electrically connected on a first conductive path between the conductive terminals 21, 22. The first fusible element 23 can be, for example and without limitation, a restraining element. Additionally, second fusible elements 24 are electrically connected on other conductive paths between the conductive terminals 21, 22. The second fusible elements 24 can be, for example and without limitation, main fusible elements. When the current flowing through the current limiting type fuse 2 exceeds a predetermined value, the second fusible elements 24 break (e.g., melt) and then the first fusible element 23 breaks (e.g., melts). The first fusible element 23 can have a relatively higher resistance than the second fusible elements 24, thus causing the second fusible elements 24 to break first. When the second fusible elements 24 break, the current flowing through the current limiting type fuse 2 flows through the first fusible element 23, thus causing it to break as well.

The current limiting type fuse 2 shown in FIGS. 3 and 4 includes a chemically activated indicator. An indicator assembly is located at one end of the current limiting type fuse 2. The indicator assembly includes a firing pin 25, a primer 26, an explosive 27, and an indicator 28. The first fusible element 23 is coupled to the firing pin 25 and restrains the firing pin 25 so it stays in the retracted position. When the first fusible element 23 breaks, the firing pin 25 is released, which in turn sets off the primer 26 and triggers the explosive 27. The explosion pushes a portion of the indicator 28 (shown in phantom line drawing in FIG. 4) through an opening 32 in the first conductive terminal 21 to the exterior of the current limiting type fuse 2 as an indication that the current limiting type fuse 2 is blown. Together, the indicator assembly along with the first and second fusible elements 23, 24 form an interruption assembly.

The interior of the current limiting type fuse 2 can also include a chamber 29 filled with an arc-quenching material 30 such as, for example and without limitation, sand. When the first or second fusible elements 23, 24 break, the sand collapses on the broken portion of the fusible elements 23, 24, thus helping to quench the arc.

The first fusible element 23 includes carbon fiber, such as for example, a plurality of strands of carbon fiber. Restraining the firing pin 25 places tension on the first fusible element 23. However, carbon fiber can withstand relatively high tensions. As such, the first fusible element 23 can employ a relatively small amount of carbon fiber and have a relatively small cross-section. Thus, the current limiting type fuse 2 can achieve relatively low amperage ratings.

Selected sections of the first fusible element 23 can use fewer strands than other sections of the first fusible element 23. The sections which use fewer strands have a smaller cross-section, and thus will break at a relatively lower current than other sections. As such, the location or locations at which the first fusible element 23 breaks can be controlled based on the number of carbon fiber strands that are used in each section of the first fusible element 23.

The second fusible elements 24 can also include carbon fiber, such as for example, a plurality of strands of carbon fiber. Selected sections of the second fusible elements 24 can use fewer strands than other sections of the second fusible elements 24, thus allowing control of the location or locations at which the second fusible elements 24 break. For example, the second fusible elements 24 can be configured to break at multiple points that are relatively evenly spaced apart from each other.

Figure 5A:
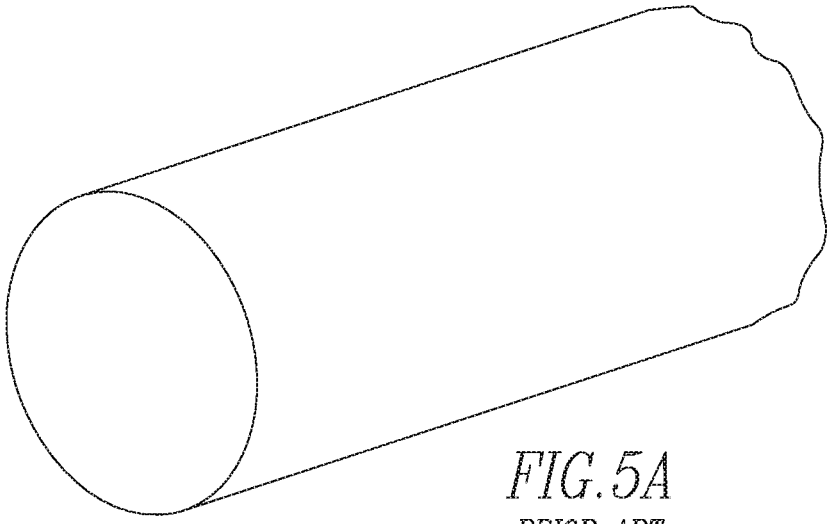
FIG. 5A PRIOR ART
FIG. 5A is an isometric view of a single wire fusible element.
Figure 5B:
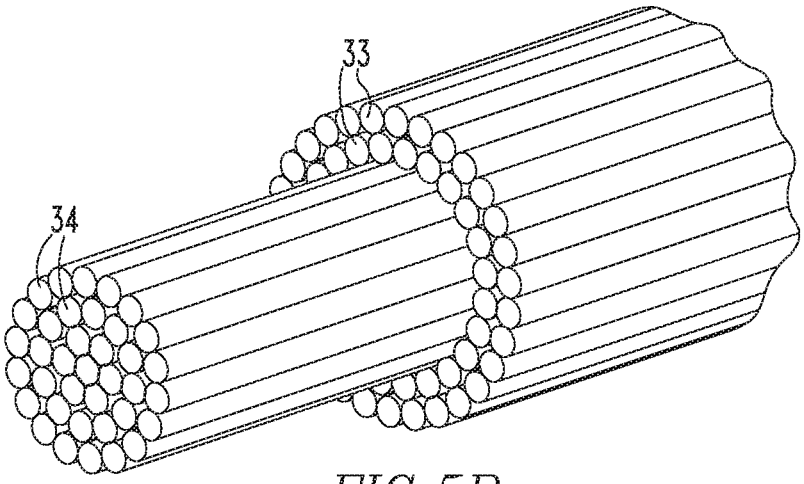
FIG. 5B is a cross-sectional view of a fusible element including a plurality of carbon fiber strands in accordance with embodiments of the disclosed concept.

FIG. 5A shows a fusible element including a single wire such as, for example, a typical fusible element made of silver alloy or nickel-chrome alloy. FIG. 5B shows a fusible element including a plurality of strands of carbon fiber in accordance with the disclosed concept. Using a plurality of strands of carbon fiber as a fusible element allows strands to be added or removed to change the size of the cross-section of the fusible element or a portion of the fusible element. For example and without limitation, one portion of the fusible element can have outer strands 33 and inner strands 34, whereas another portion of the fusible element can a number of the outer strands 34 removed. As such, the portion of the fusible element having the number of the outer strands 33 removed will have a smaller cross-section and break before the portion where the outer strands 33 are not removed. It is contemplated that any number of strands may be added or removed from any portion or portions of the fusible element without departing from the scope of the disclosed concept. In a typical fusible element, which is a single wire, the entire fusible element may need to be replaced to change the cross-sectional area of the fusible element.

While the expulsion type fuse 1 shown in FIGS. 1 and 2 includes a mechanical spring indicator and the current limiting type fuse 2 shown in FIGS. 3 and 4 includes a chemically activated indicator, the disclosed concept is not limited to these examples. The expulsion type fuse 1 and the current limiting type fuse 2 can each include any suitable type indicator assembly. For example and without limitation, the expulsion type fuse 1 can include a chemically activated indicator and the current limiting type fuse 2 can include a mechanical spring indicator. Additionally, it is contemplated that the indicators can be omitted from the expulsion type fuse 1 or the current limiting type fuse 2 without departing from the scope of the disclosed concept.

The expulsion type fuse 1 or the current limiting type fuse 2 can be suitably employed as medium voltage fuses. However, the disclosed concept is not limited thereto. It is contemplated that the expulsion type fuse 1 or the current limiting type fuse 2 can be modified for use at any suitable voltage (e.g., without limitation, high voltage) without departing from the scope of the disclosed concept.

In both the expulsion type fuse 1 and the current limiting type fuse 2, any known methods may be used to mechanically connect the fusible elements 13, 23 to other components of the fuses 1, 2 without departing from the scope of the invention. For example and without limitation, the fusible elements 13, 23 can be mechanically connected to other components of the fuses 1,2 by crimping, pinching, knots, loops, or any other suitable connection method.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An expulsion type fuse comprising:

a body;

a first conductive terminal coupled with a first end of the body;

a second conductive terminal coupled with a second end of the body, wherein the body, the first conductive terminal, and the second conductive terminal define an exterior of the fuse;

a fusible element including carbon fiber, the fusible element being disposed on a conductive path between the first conductive terminal and the second conductive terminal, and being configured to break when a current through the fusible element exceeds a predetermined current; and a spring that applies tension to the fusible element, wherein the carbon fiber included in the fusible element is a plurality of carbon fiber strands including a plurality of inner carbon fiber strands and a plurality of outer carbon fiber strands, wherein a first portion of the fusible element includes the inner carbon fiber strands and the outer carbon fiber strands and the outer carbon fiber strands surround the inner carbon fiber strands, wherein a second portion of the fusible element includes the inner carbon fiber strands and does not include the outer carbon fiber strands, and wherein a cross-sectional area of the second portion is less than a cross-sectional area of the first portion.

2. The expulsion type fuse of claim 1, wherein the expulsion type fuse includes a chamber having an arc-extinguishing material therein; and wherein the fusible element breaking causes the arc-extinguishing material to emit an arc-extinguishing gas.

3. The expulsion type fuse of claim 2, wherein the arc-extinguishing material includes boric acid.

4. The expulsion type fuse of claim 1, further comprising:

an indicator assembly including an indicator member that provides a visible indication when the fusible element breaks.

5. The expulsion type fuse of claim 4, wherein the spring applies a bias to the indicator member; and wherein the fusible element maintains the spring in a non-relaxed state when the current through the fusible element is less than the predetermined current, and to break and release the spring when said current exceeds said predetermined current.

6. The expulsion type fuse of claim 5, wherein when the fusible element breaks and releases the spring, a portion of the indicator member moves through the second conductive terminal to the exterior of the fuse.

7. The expulsion type fuse of claim 1, wherein the fuse is a medium voltage fuse.

* * * * *